United States Patent [19]

Braun

[11] 4,372,619

[45] Feb. 8, 1983

[54] CHAIN HAVING LONGITUDINAL STIFFNESS USED WITH HAULING AND CUTTING EQUIPMENT

[75] Inventor: Gert Braun, Essen-Heisingen, Fed. Rep. of Germany

[73] Assignee: Halbach & Braun, Fed. Rep. of Germany

[21] Appl. No.: 185,900

[22] Filed: Sep. 10, 1980

[30] Foreign Application Priority Data

Sep. 22, 1979 [DE] Fed. Rep. of Germany ..... 2938408

[51] Int. Cl.[3] ..... E21C 29/10

[52] U.S. Cl. ..... 299/43; 474/210

[58] Field of Search ..... 299/32, 34, 43, 50; 474/155, 206, 210; 59/5

[56] References Cited

U.S. PATENT DOCUMENTS 547,319 10/1895 Bardet ..... 474/155

3,753,595 8/1973 Lanfermann ..... 299/43

4,269,304 5/1981 Braun et al. ..... 299/43 X

FOREIGN PATENT DOCUMENTS 1185115 1/1965 Fed. Rep. of Germany ..... 474/210

*Primary Examiner*—Ernest R. Purser

*Attorney, Agent, or Firm*—McGlew and Tuttle

[57] ABSTRACT

Hauling and cutting equipment includes a conveyor trough having a longitudinal side wall on each side with a support rail structure on at least one side having a chain guide groove therealong through which a endless link chain extends. A cutting machine overlies the trough and is guide on the rail structure and includes a drive on one side with a sprocket or chain wheel which has teeth which engage in horizontally disposed links of the link chain. The space between the teeth accommodates the vertically disposed links of the chain. The link chain comprises long horizontal links and short vertical links which are shorter than the horizontal links. The clear division of the vertical links correspond to the double link diameter of the horizontal links except for a mall clearance for movement play. The engagement division of the chain wheel is matched to the length of the vertical links.

6 Claims, 4 Drawing Figures

CHAIN HAVING LONGITUDINAL STIFFNESS USED WITH HAULING AND CUTTING EQUIPMENT

FIELD AND BACKGROUND OF THE INVENTION

This invention relates in general to hauling and cutting equipment and in particular to a new and useful combination of a trough conveyor and a cutting machine which is driven by a chain wheel which engages in a sprocket which extends along the length of one side of the conveyor and to an improved construction of chain links for such conveyors.

The invention relates in particular to hauling and cutting equipment having a cutting machine or similar winning machine bridging the conveyor trough of a conveyor, in particular a chain scraper conveyor, in portal fashion. The drive is disposed on the stowage side and comprises at least one chain wheel engaging in a round-link chain, the round-link chain being arranged in a runner rail profile with engagement grooves for the chain wheel of a base frame connected to the trough wall of the conveyor on the stowage side, and extending in lengthwise direction of the conveyor.

A chain scraper conveyor with a cutting train chain conduction is known where a plate link chain is used as a drive chain for the chain wheel. This is disadvantageous in several respects. As is known, a plate link chain consists of only horizontal links where the plate links are connected together through hinge pins. Such a plate link chain is movable in one plane only, namely, in a horizontal arrangement, in the vertical plane only. Horizontal arrangement is necessary in a cutting train chain conduction so that the chain wheel can engage into the plate link chain from above. This mobility reduced to only one, namely the vertical plane is, however, insufficient in a chain scraper conveyor, because a chain scraper conveyor travels regularly not only through depressions and saddles, but frequently also through curves. In a curved path, however, inflections necessarily occur in the horizontal plane between the individual trough sections. A plate link chain, however, cannot follow such inflections for the above-mentioned reasons. Besides, inflections in the horizontal plane between the trough sections occur in principle also as the chain scraper conveyor is being moved. It must always be provided that the drive chain can follow the curved and in part sharply bent path of the chain scraper conveyor. With a plate link chain this is practically impossible. Consequently, perfect engagement of the chain wheel at the winning machine is not ensured at least when the path of the chain scraper conveyor is curved.

To avoid these disadvantages, a form of construction has become known wherein the drive chain is formed as a round link chain and whose horizontal links are guided with slight vertical and horizontal movement play and the vertical links with large vertical and horizontal movement play in a hollow profile. Thereby the drive chain is given a flexibility such that it exceeds by adaptability in horizontal as well as in a vertical plane to the chain scraper conveyor or respectively the hollow profile intended for the chain conduction. In fact, the flexibility of the round-link chain is maintained even when the horizontal links are guided with extremely little movement play, while the movement play of the vertical links remain practically unlimited. Actually there results thereby between each horizontal and vertical link a vertical and horizontal articulated axle. It is, therefore, entirely immaterial in which transitional regions from trough section to trough section the chain scraper conveyor flexes or buckles as it passes through curves or as it is being moved. The round-link chain, as a drive chain, can always adapt itself to this inflection because of its vertical and horizontal articulated axle existing right there. Some problems will arise, however, when because of the relatively large movement play between the horizontal links and the vertical links the links of the round-link chain pull away from and pushing into one another.

Pulling of the links away from and pushing into one another can occur, for example, when the chain scraper conveyor is being used in steep or semi-steep suspension, so that the links will slip at an inclination in excess of the self-locking. But also for other reasons a pulling of the links away from and pushing into one another cannot be ruled out. Then, however, a division correct engagement between the chain wheel and the round-link chain is no longer ensured, and in addition, an angle bend of the trough sections in the region at least of the expanded links is possible only in limited extent. When the engagement between chain wheel and round-link chain is disturbed, it often happens that the tooth of the chain wheel following the engagement does not bear temporarily, while disengagement at the last tooth in engagement is impaired, so that the round-link chain suffers and considerable tooth stress occurs, requiring increased driving power for the chain wheel.

SUMMARY OF THE INVENTION

The invention provides hauling and cutting equipment, wherein the round-link chain is stabilized over the length of the hauling trough in such a way that under any operating and slope conditions, a pulling of the links away from and pushing into one another is impossible and consequently, a perfect and division correct engagement between chain wheel and round-link chain is ensured even when the chain scraper conveyor travels through saddles, depressions and curves or is used in semi-steep or steep suspension.

In accordance with the invention hauling and cutting equipment includes round-link chain of long horizontal links and short vertical links, with a clear division of the vertical links corresponding to double the link diameter of the horizontal links except for a given movement play, and the engagement division of the chain wheel is matched to the external length of the vertical links. The result of these measures of the invention is that, due to the minimal movement play between its links, the chain strand is considerably stiffened in a lengthwise direction of the chain and consequently a pulling of the chain links away from and pushing into one another is avoided, regardless of the prevailing operating and slope conditions, or this is at least reduced to such an extent that always a satisfactory chain division is preserved, namely over the total length of the round-link chain. Even as a stiffened chain strand, the round-link chain remains intact as a continuous chain. The same applies with respect to its flexibility for compensating the maximum angle bend of adjacent trough sections in a horizontal and a vertical plane so as to ensure satisfactory travel through saddles and depressions or curves as well as advancing of the hauling trough. Proper engagement and quiet running of the chain wheel is always ensured. Moreover, the specific load on the teeth of the chain wheel is reduced, because now, due to the short vertical links of the round-link chain as compared with the horizontal links, the chain wheel can have more teeth than before at constant base circle, that is, on the base circle a smaller tooth pitch can be realized. Thereby at the same time the radial forces directed counter to the engagement between chain wheel and round-link chain are reduced. Besides, due to the relatively short vertical links or the minimal movement play between the link area of the horizontal links and the vertical links, a mutual support between the horizontal links is achieved. As a result of this support, the tensile forces transmitted from the driven chain wheel to the round-link chain in the forward running region as the cutting machine travels are reduced by compressive forces building up in the backward running region. Consequently, also the specific loads on the round-link chain or on its links are diminished and thereby its useful life is increased. Lastly, it is of importance that upon chain rupture the chain wheel is stopped if, for example, the hauling and cutting equipment according to the invention is being used in semi-steep or steep suspension. In fact, because of the longitudinal stiffness of the chain strand and the friction conditions between the round-link chain and the rail profile and also because of the extremely small movement play between the horizontal links, the chain strand fulfills a blockage function for the chain wheel, so that the cutting machine cannot run back.

Further features important to the invention are set forth in the following: Preferably the clear division of the horizontal links is two to three times greater than the clear division of the vertical links. According to the invention, the vertical links are formed as circular links, so that they can assume a rolling function and therefore, satisfactory alignment of the round-link chain in the rail profile is always ensured. At any rate, in consideration of the narrow movement play between the horizontal links, any connection in the vertical links is avoided and yet a supporting function is achieved between the horizontal links with reduction of the expansion path of the chain strand by tensile and compressive compensation. To this contributes also the measure of the invention that the inside radius of the link arcs of the vertical links in the contact region corresponds to the inside radius of the link arcs of the horizontal links. Preferably the link diameter of the vertical links is chosen greater than the link diameter of the horizontal links, that is, the horizontal links are wider than the vertical links. It is thereby possible to use a chain wheel with especially wide teeth and hence especially large contact faces in the region of the tooth flanks, so that also in this respect the specific load on the tooth flanks is considerably reduced. According to a proposal of the invention which is of independent importance, it is provided that on its outer side toward the working face the chain wheel has a tread and, on its inner side between the teeth engaging in the horizontal links, chambers for partial uptake of the vertical links, and that the rail profile comprises a guide profile associated with the tread for support of the chain wheel on the working face side. From these measures results, both a satisfactory tracking, and also an increased lateral guiding of the chain wheel and hence of the cutting machine.

The advantages achieved by the invention must be seen essentially in that a hauling and cutting equipment is realized wherein, although the flexibility of the driving chain designed as a round-like chain is maintained, yet in a horizontal and a vertical plane a lengthwise stiffness of the chain strand is achieved such that always satisfactory and division correct engagement between the chain wheel and chain strand is ensured even when the chain scraper conveyor travels through saddles, depression and curves, when it is moved, or when it is used in semi-steep or steep suspension. By the longitudinal stiffness of the chain strand pulling of the links away from, or pushing into one another is either always avoided or is reduced except for the given movement play between the horizontal links, so that in the end result a uniform distribution of all interengaging links over the length of the total cutting train chain conduction is ensured even under different operating and slope conditions. This is achieved with the aid of relatively simple and properly functioning means.

Accordingly, it is an object of the invention to provide hauling and cutting equipment which includes a conveyor trough having a longitudinal side wall at each side with a support rail structure on at least one side having a chain guide groove therealong with a link chain disposed in the guide groove arranged so as to be engaged by a drive sprocket or tooth wheel of a cutting machine and wherein the horizontal links of the chain are made longer than the vertical links and they are constructed to a desired dimensional relationship to achieve advantages of operation.

A further object of the invention is to provide a hauling and cutting device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
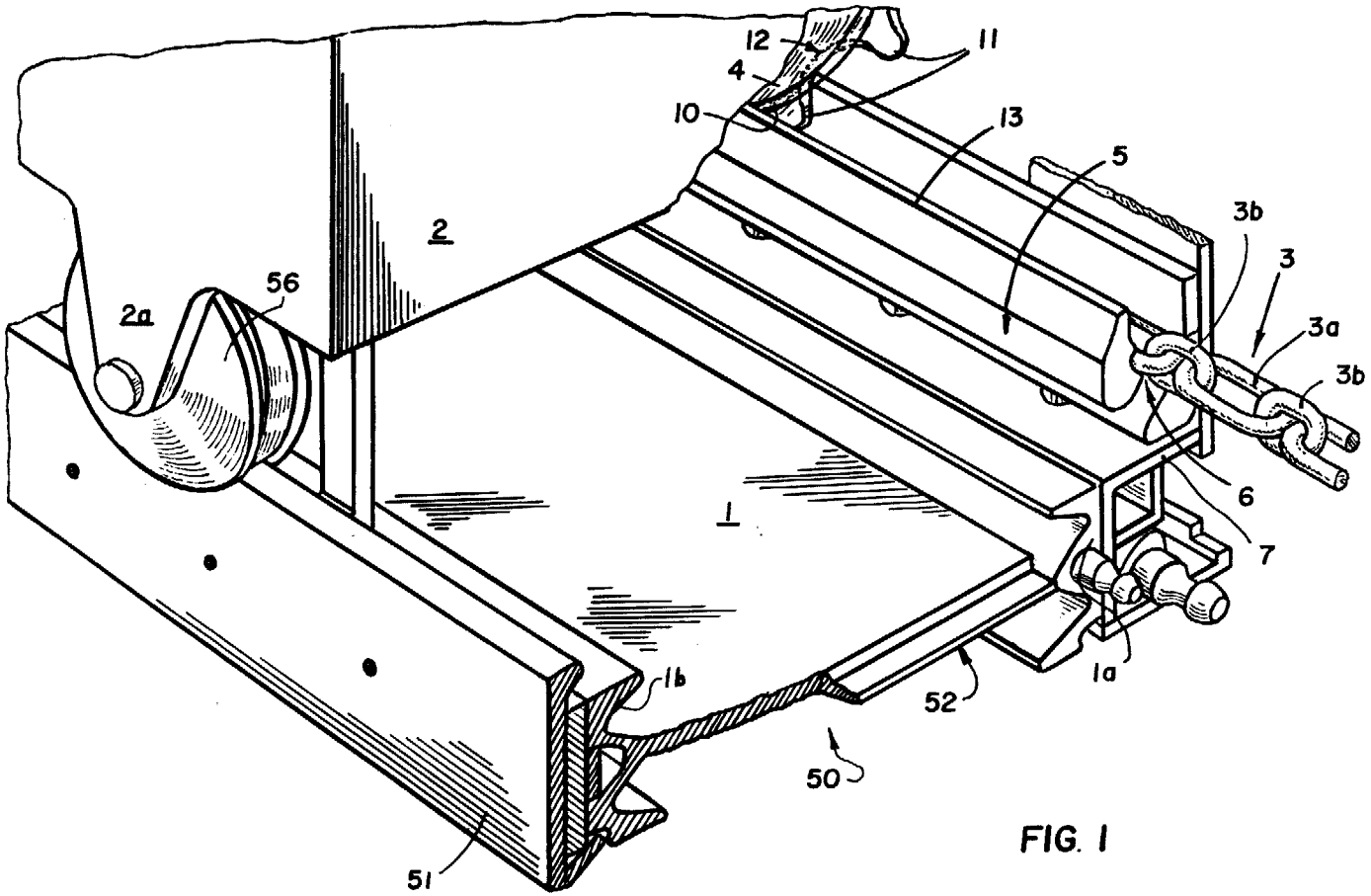
FIG. 1 is a front top perspective view, partly in section of a portion of a cutting and hauling device constructed in accordance with the invention.
Figure 2:
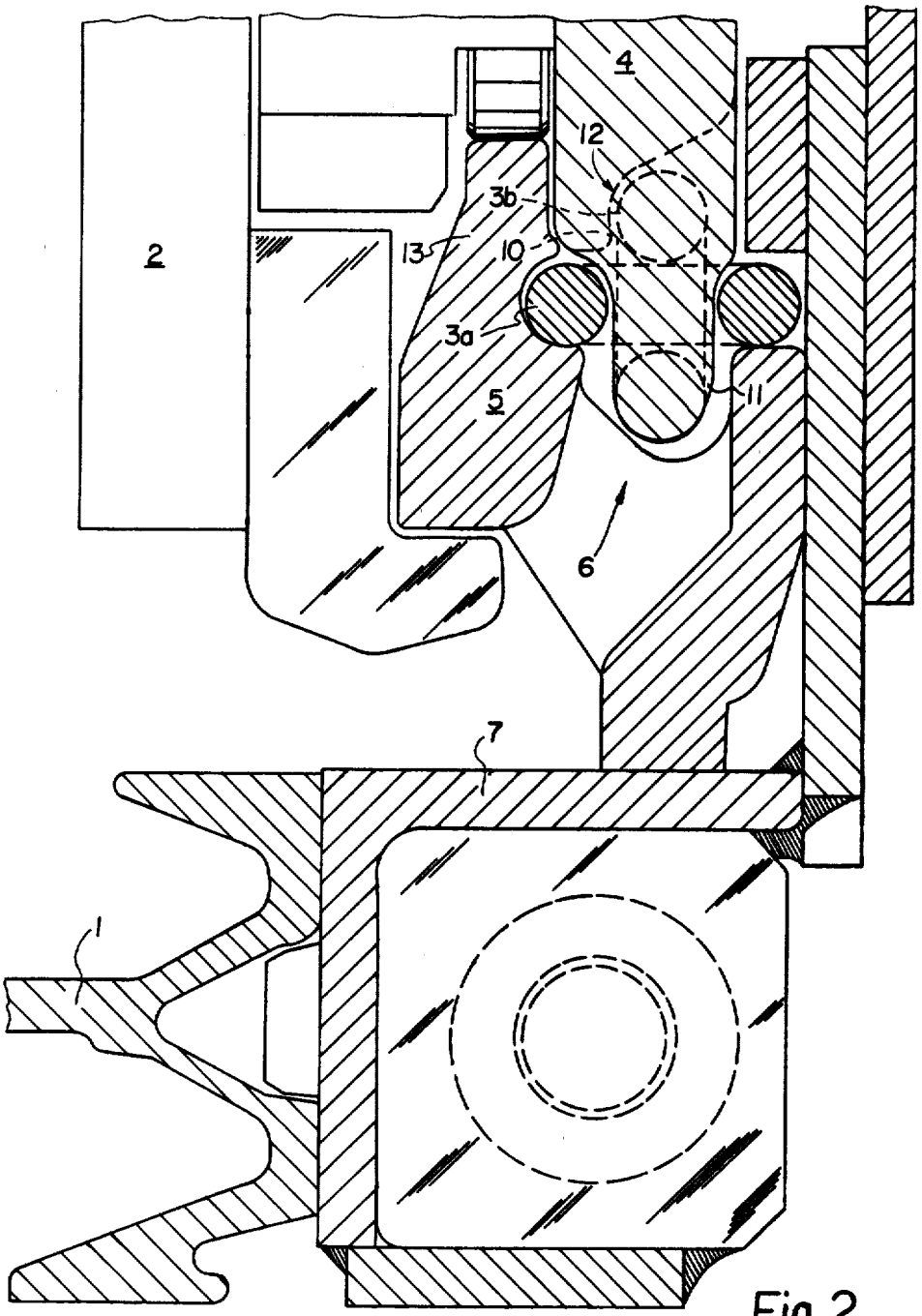
FIG. 2 is a vertical sectional view of a right-hand portion of the device shown in FIG. 1.

Referring to the drawings in particular, the invention embodied therein comprises a hauling and cutting device or equipment generally designated 50 which in the embodiment shown includes a conveyor generally designated 52 which is arranged beneath a cutting machine 2 which is guided over the conveyor 52. The conveyor 52 includes a conveyor trough 1 having longitudinal side walls 1*a* and 1*b* on respective sides with a support rail structure or rail profile generally designated 5 arranged along one of the sides, the side 1*a*. A round-link chain generally designated 3 is disposed in a longitudinally extending engagement groove 6 defined along the rail profile and constructed such that the link chain 3 is oriented so that horizontal links 3*a* are guided horizontally over the trough 1 and vertical links 3b are maintained in a vertical disposition. The link chain 3 is engaged on a drive sprocket or chain wheel 4 of a drive for a cutting machine 2 which is guided over the conveyor 52 and advantageously includes a support bracket 2a overlying the side wall 1b and guided on a rail profile 5' by means of a guide wheel 56.

In the figures is shown hauling and cutting equipment having a cutting machine 2 or similar winning machine bridging the conveyor trough 1 of a conveyor, in particular a chain scraper conveyor, in portal fashion. The drive of the cutting machine 2 is disposed on the stowage side, and it comprises at least one chain wheel 4 engaging in a round-link chain 3, the round-link chain 3 being arranged in a rail profile 5 having an engagement groove 6 for the chain wheel 4. The rail profile 5 includes a base frame 7 connected to the trough side wall 12 of the conveyor trough 1 on the stowage side and extending in lengthwise direction of the conveyor.

Figure 3:
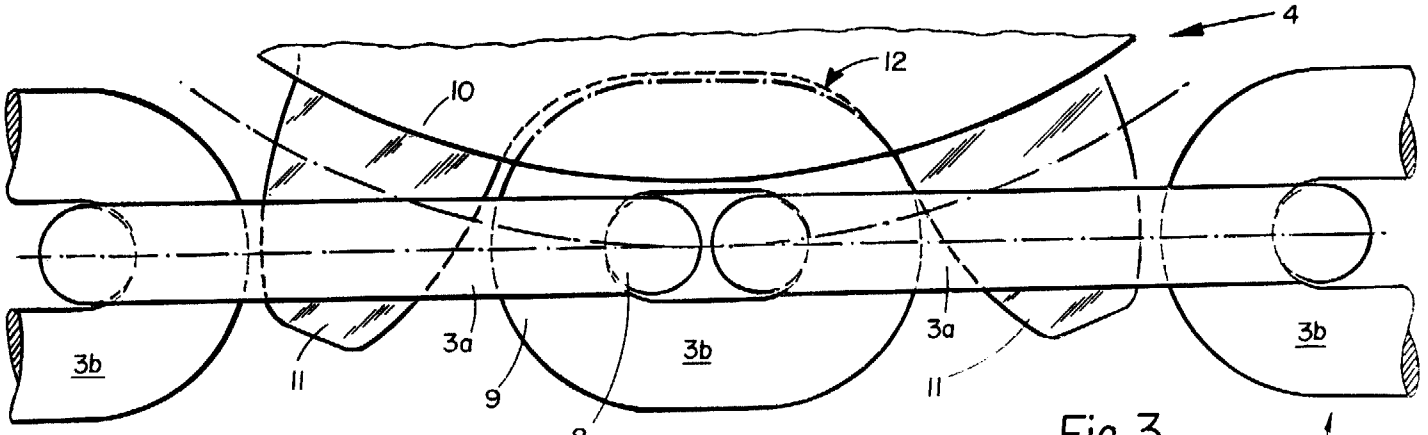
FIG. 3 is a partial side elevational view showing the engagement of the drive sprocket with the link chain.
Figure 4:
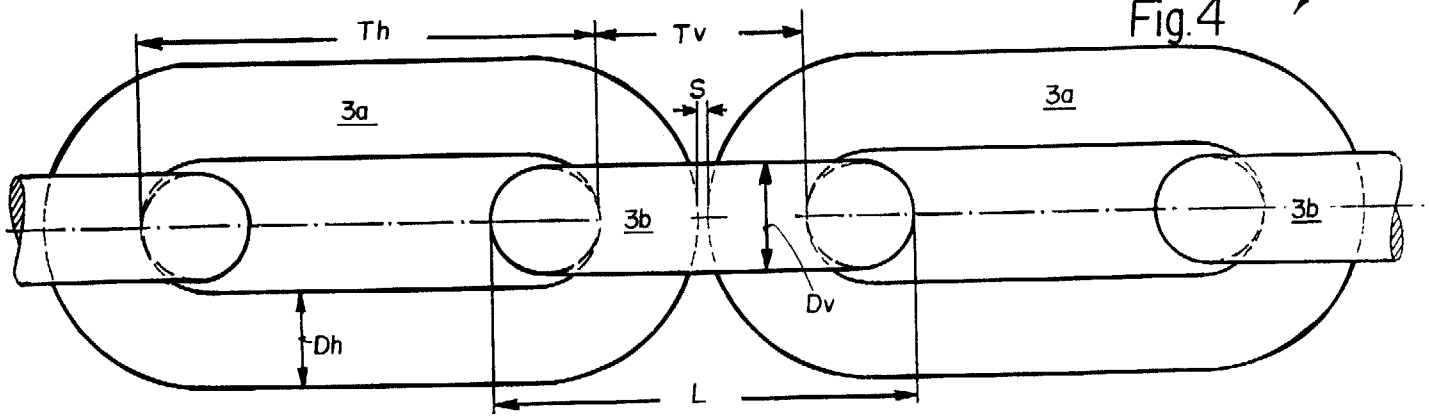
FIG. 4 is a top plan view of a portion of the link chain showing the dimensional relationships of the links.

The round-link chain 3 consists of long horizontal links 3a and short vertical links 3b. As shown in FIGS. 3 and 4, a clear division Tv of the vertical links 3b corresponding except for a given movement play S to double the link diameter Dh of the horizontal links 3a. The link arcs 8 of the horizontal links 3a are thus spaced in the vertical links 3b only by the movement play S between them. The engagement division of the chain wheel 4 is matched to the outer length L of the vertical links 3b. The clear division Th of the horizontal links 3a is greater, by two to three times, the clear division Tv of the vertical links 3b. Thus for example, in a round-link chain 3 having a link diameter D of 34 mm, the clear division Tv of the vertical links 3b may be 70 mm, and the clear division Th of the horizontal links 3a 159 mm. The vertical links 3b may be formed as circular links; this is not shown. The inside radius of the link arcs 9 of the vertical links 3b corresponds in the contact region to the inside radius of the link arcs 8 of the horizontal links 3a. The link diameter Dv of the vertical links 3b is chosen greater than the link diameter Dh of the horizontal links 3a. On its external side turned toward the working face, the chain wheel 4 has a tread 10, and, on its internal side between its teeth 11 engaging in the horizontal links 3a chambers 12 for partial uptake of the vertical links 3b. The rail profile 5 has a guide profile part 13 associated with the tread 10, for support of the chain wheel 4 on the working face side.

While a specific embodiment of the invention has been shown and described in detail to illustrate the application of the principles of the invention, it will be understood that the invention may be embodied otherwise without departing from such principles.

What is claimed is:

1. Hauling and cutting equipment, comprising a conveyor trough having a longitudinal side wall on each side, a support rail structure on at least one side of said trough having a chain guide groove therealong, a link chain extending in said chain guide groove along said support structure, a winning machine overlying said trough and guided on said rail structure, a drive for said winning machine including at least one chain wheel on said winning machine having teeth engaging in said link chain and having vertical link receiving divisions between said teeth, said link chain comprising a round link chain having alternate long horizontal links and short vertical links of a shorter length than said horizontal links, a clear division of said vertical links being substantially double the link diameter of said horizontal links except for a predetermined amount of play spacing, the engagement division of said chain wheel being substantially equal to the length of said vertical links, said vertical links have link arcs with an inside radius corresponding in the contact region with said horizontal link to the inside radius of the link arc of said horizontal link.

2. Hauling and cutting equipment according to claim 1 wherein said clear division of the horizontal links is at least two times greater than the clear division of said vertical links.

3. Hauling and cutting equipment according to claim 1 wherein said vertical links are formed as circular links.

4. Hauling and cutting equipment according to claim 1 wherein said vertical links have a link diameter which is greater than the link diameter of said horizontal links.

5. Hauling and cutting equipment according to claim 1 wherein said chain wheel includes a side working face having a tread, said rail profile having a guide rail portion engaged by said tread with the support of said chain wheel.

6. Hauling and cutting equipment according to claim 1 including a base frame adjacent one side of said conveyor trough supporting said support rail structure, said support rail structure including a rail profile defining said chain groove having a guide profile disposed on a side facing said trough, said chain wheel having an annular tread portion engaged on said guide profile and said winning machine including a cutting machine guide wheel, and including an opposite side guide rail secured to the opposite side of said conveyor and engaged by said winning machine guide wheel.

* * * * *